United States Patent [19]

Kent

[11] 4,391,220

[45] Jul. 5, 1983

[54] APPARATUS FOR APPLYING FLUID TO ARTICLES

[75] Inventor: William C. Kent, Garland, Tex.

[73] Assignee: Western Electric Company, Inc., New York, N.Y.

[21] Appl. No.: 376,875

[22] Filed: May 10, 1982

[51] Int. Cl.[3] ..... B05C 3/10; B05C 11/00; B05C 13/02

[52] U.S. Cl. ..... 118/707; 118/425; 134/46; 134/47; 134/57 R; 134/143; 134/164; 134/200

[58] Field of Search ..... 118/707, 425; 134/46, 134/47, 143, 57 R, 164, 200

[56] References Cited

U.S. PATENT DOCUMENTS

| | | | |
|---|---|---|---|
| 1,807,634 | 6/1931 | Okun | 134/143 |
| 2,724,392 | 11/1955 | Cooper | 134/46 |
| 3,273,256 | 9/1966 | Behrens | 34/45 |

*Primary Examiner*—Evan K. Lawrence
*Attorney, Agent, or Firm*—R. P. Miller

[57] ABSTRACT

An apparatus is provided for applying lubricant to articles such as connectors. The connectors 10 with projecting terminals 12 are loaded into a holder 19 enclosed within a housing 16 having an entry door 23. The door is shut and lubricant is pumped into a tank 28 to overflow into a catch receptacle 66 whereafter the holder is moved to dip the terminal ends into the lubricant. During the dipping operation a pair of locking members 98 and 133 are positioned to block opening of the door. Following the dipping operation the locking member 98 is withdrawn while the lubricant is drained from the receptacle. Upon completion of the draining of the receptacle, facilities 126–132 are operated to withdraw the locking member 133 thus permitting an attending operator to open the door without exposure to any noxious frames emanating from the lubricant.

10 Claims, 9 Drawing Figures

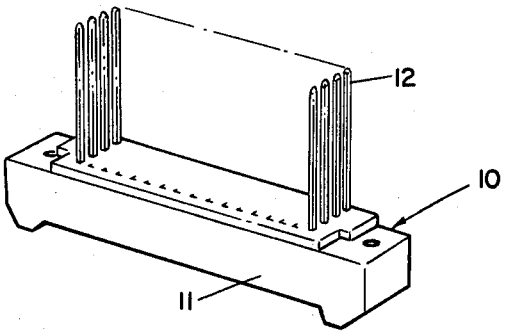
FIG. 1
FIG. 2
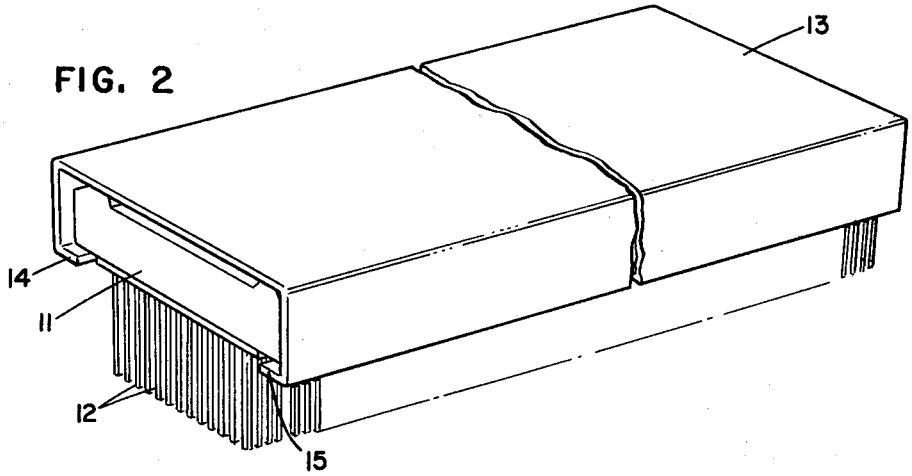
FIG. 8
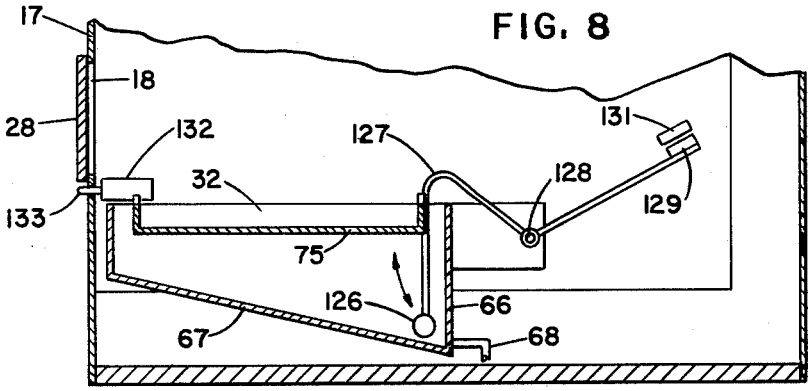

FIG. 6
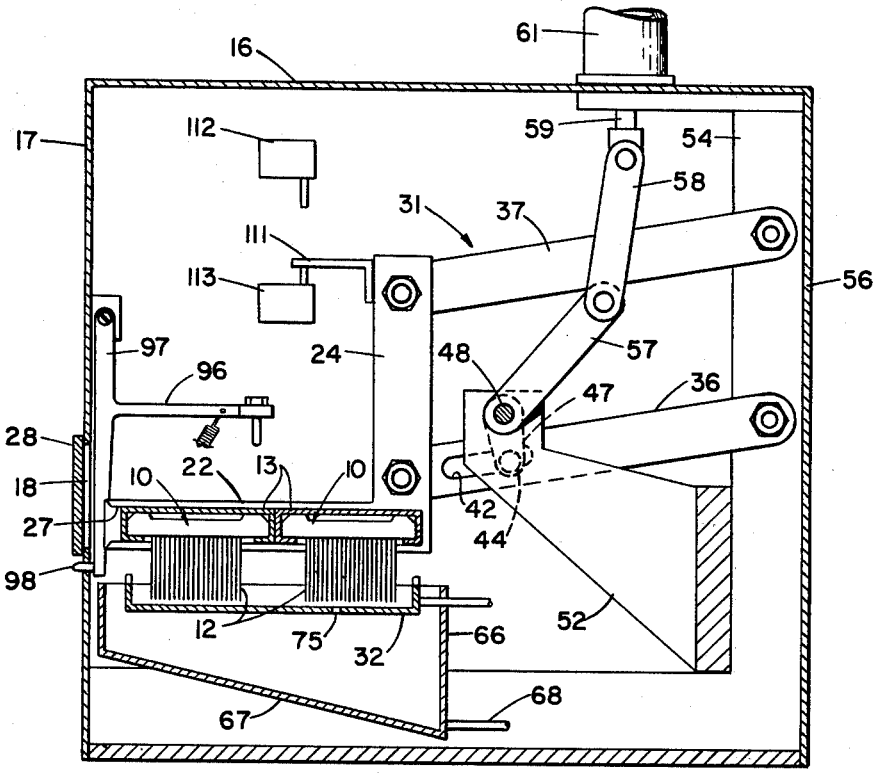
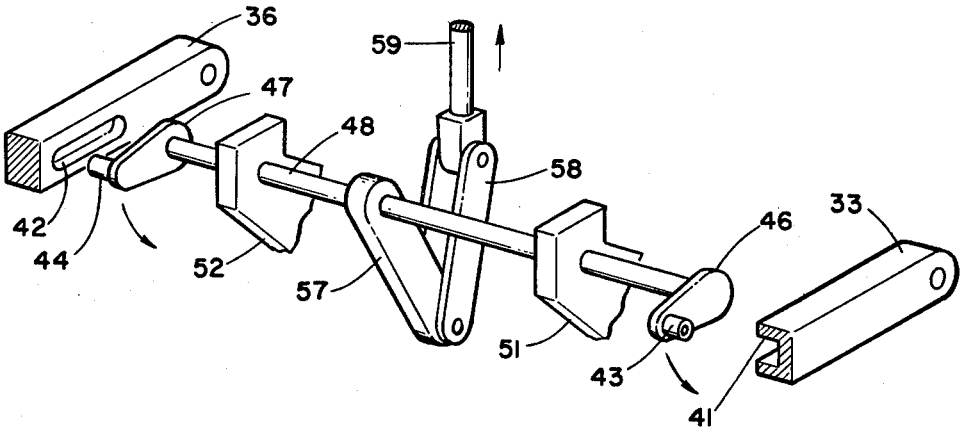
FIG. 7

APPARATUS FOR APPLYING FLUID TO ARTICLES

FIELD OF THE INVENTION

This invention relates to apparatus for applying fluid to articles and, more particularly, to apparatus for immersing articles in a tank which is filled during the time that the articles are within the apparatus and then is drained during periods in which articles are unloaded and loaded into the apparatus.

BACKGROUND OF THE INVENTION

There are numerous manufacturing processes wherein it is necessary that an article or a section thereof be immersed in a volatile noxious fluid for the purpose of lubricating, coating or cleaning the article. Ventilation systems are often used in such installations to vent the fumes to the outside atmosphere. This minimizes exposure of an attending operator to the noxious fumes. One industry that is particularly faced with this problem is the dry cleaning industry where machines have been developed to perform the dry cleaning operations within a closed housing. Facilities are provided for these machines to introduce the cleaning fluid only during periods in which the actual cleaning is performed, and such machines are usually provided with interlocks that prevent the opening of a door during operation of the machine. Further, these machines include facilities for draining the cleaning fluid upon completion of the tumbling of the clothes in the fluid.

An example of such a dry cleaning machine is disclosed in U.S. Pat. No. 3,273,256 issued Sept. 20, 1966, to C. E. Behrens, wherein clothes are loaded through an entry door into a rotatable basket. An interlock system is provided so that the door must be closed prior to the admission of cleaning fluid from a storage tank into a bottom section of a tub. The basket is rotated to tumble the clothes in the fluid, during which time fluid is continuously flowed into and out of the bottom of the tub. The withdrawn fluid is soiled and facilities are provided to filter the fluid prior to return to the storage tank. The door interlock not only prevents starting of the machine until the door is closed, but also prevents opening of the door until such time as the cleaning fluid is drained from the tub.

Many recent telecommunication switching modules are constructed to be interconnected by connectors having a socket-like body portion for receiving printed circuit modules and a coordinate array of projecting terminal pins on which other connectors are mounted or wires secured thereto. Electrical integrity of the connections is enhanced by plating the projecting terminals with a thin layer of gold. Obviously, the thinner the layer of gold plate, the less expensive the connector. However, there is a physical limit as to how thin the gold layer may be before the layer will be effectively destroyed by erosion and wear caused by the repetitive assembly and disassembly of connectors on the terminal pins.

It has been found that the wear life of the terminal pins can be substantially extended by applying a thin coating of a lubricant, such as a polyphenyl ether. To insure dispersion of the lubricant coating over the entire area of the terminals, the lubricant is usually dispersed in a volatile solvent, such as 1-1-1 trichlorethane. Other volatile solvents may be used, such as those sold under the trademark Freon. Solvents of these types are volatile and at room termperatures often give off noxious fumes which must be vented from the area of application. Such venting facilities are expensive and occupy considerable areas of worthwhile valuable manufacturing space. There is a need for a facility for applying such a lubricant to large numbers of terminals without subjecting an attending operator to noxious fumes.

SUMMARY OF THE INVENTION

This invention contemplates, among other things, an apparatus for applying a uniform amount of lubricant dissolved in a volatile solvent to an article, such as a connector having an array of projecting terminals. The apparatus features an enclosure having an entry opening that is closed by a door which is locked during the application of the lubricant. Positioned within the enclosure is an article holder that is moved to partially immerse the article in a volatile fluid which is admitted to the enclosure at the time that the door is closed and locked. The lubricant is withdrawn from the enclosure prior to the unlocking and opening of the door, thus minimizing evaportion of the solvent and exposure of an attending operator to solvent fumes.

More particularly, the apparatus features a mechanical locking device which positions one or more pins to lock the closed door during a cycle of operation of the lubricant applying facilities. When the door is closed, a pump is actuated to deliver a supply of lubricant to a tank within the enclosure. Simultaneous therewith, an article holder is activated to move toward the tank to immerse a portion of the article in the lubricant. Following immersion of the article, instrumentalities are rendered effective to withdraw the article holder, whereafter the movement of the article holder to the initial position acts to withdraw the mechanical lock. During the time that the article holder is being withdrawn, the pump is stopped and a drain is rendered effective to withdraw the lubricant from the tank, thus minimizing the period in which fumes can be produced. A liquid level detector is installed in the tank that controls a second door lock to insure that the lubricant is drained before the door can be opened. Inasmuch as the door is closed and locked during the time the lubricant is flowed into and out of the enclosure and during the time of the immersion of the article, the attending operator is not exposed to noxious fumes.

BRIEF DESCRIPTIONS OF THE DRAWINGS

Other features and advantages of the invention will be apparent upon consideration of the following detailed description when considered in conjunction with the drawings, wherein:

FIG. 1 is a perspective view of a connector having a projecting array of terminals which may be coated with a lubricant by the apparatus shown in the other figures;

FIG. 2 is a perspective view of a magazine for receiving a number of connectors;

FIG. 6 is a sectional view taken along line 6—6 of FIG. 5 particularly showing a mechanism for moving a holder containing a number of magazines toward and away from a tank of lubricant;

FIG. 7 is a perspective view of the mechanism for imparting a translatory motion to the magazine holder during movement toward and away from the lubricant tank;

FIG. 8 is a side elevational view, in section, showing an additional facility for holding the entry door in closed position until substantially all the lubricant is drained from the lubricant tank.

DETAILED DESCRIPTION

Figure 3:
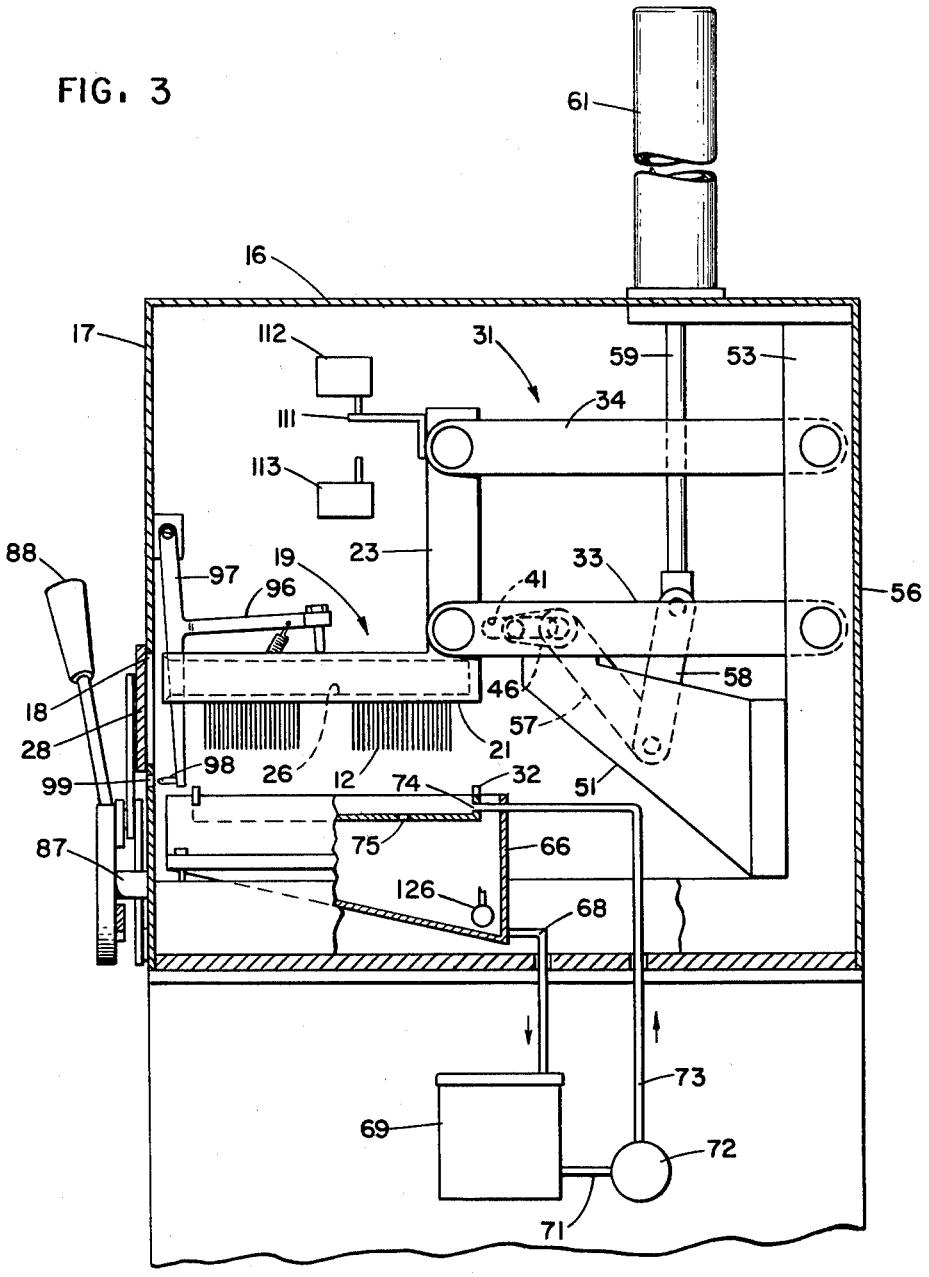
FIG. 3 is a side elevational view of the lubricant applying apparatus partially cut away and showing the mechanisms for immersing connector terminals in a lubricant.

Referring to FIG. 1 for a consideration of an article that is to be coated with a lubricant in a solvent by the apparatus of the invention, there is shown a connector 10 having a socket body portion 11 and a projecting coordinate array of terminals 12 that have been previously plated with a thin layer of gold. A number of connectors to be lubricated are loaded into a magazine 13 as shown in FIG. 2. This magazine may be made of sheet metal and is formed to provide a pair of inwardly extending lips 14 and 15 for supporting end sections of a number of connectors 12 with the terminals projecting from between the lips 14 and 15.

Figure 4:
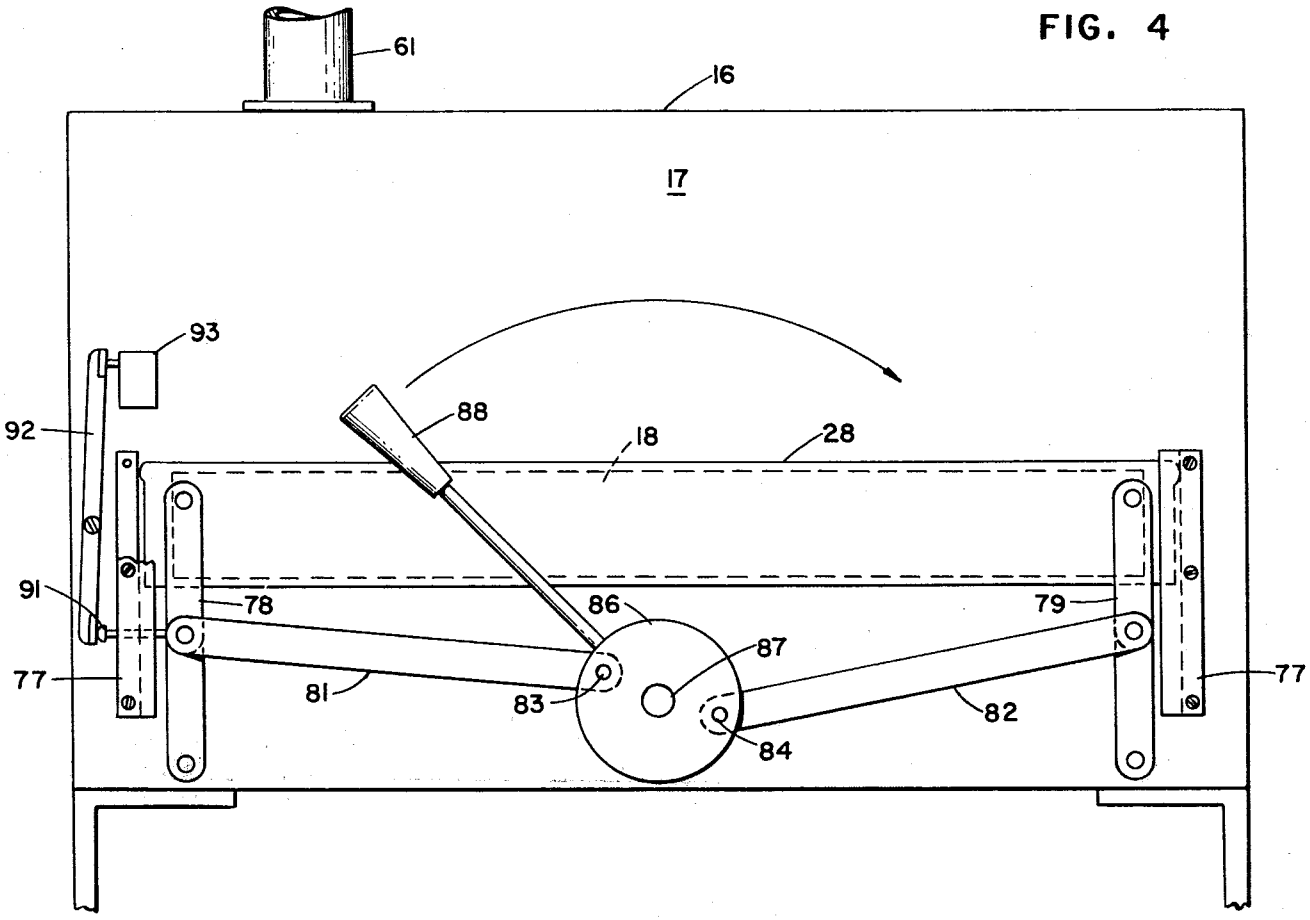
FIG. 4 is a front view of the apparatus partially cut away illustrating an entry door mechanism that is locked during application of the lubricant and which is utilized to control the initiation of a cycle of operation of the apparatus.
Figure 5:
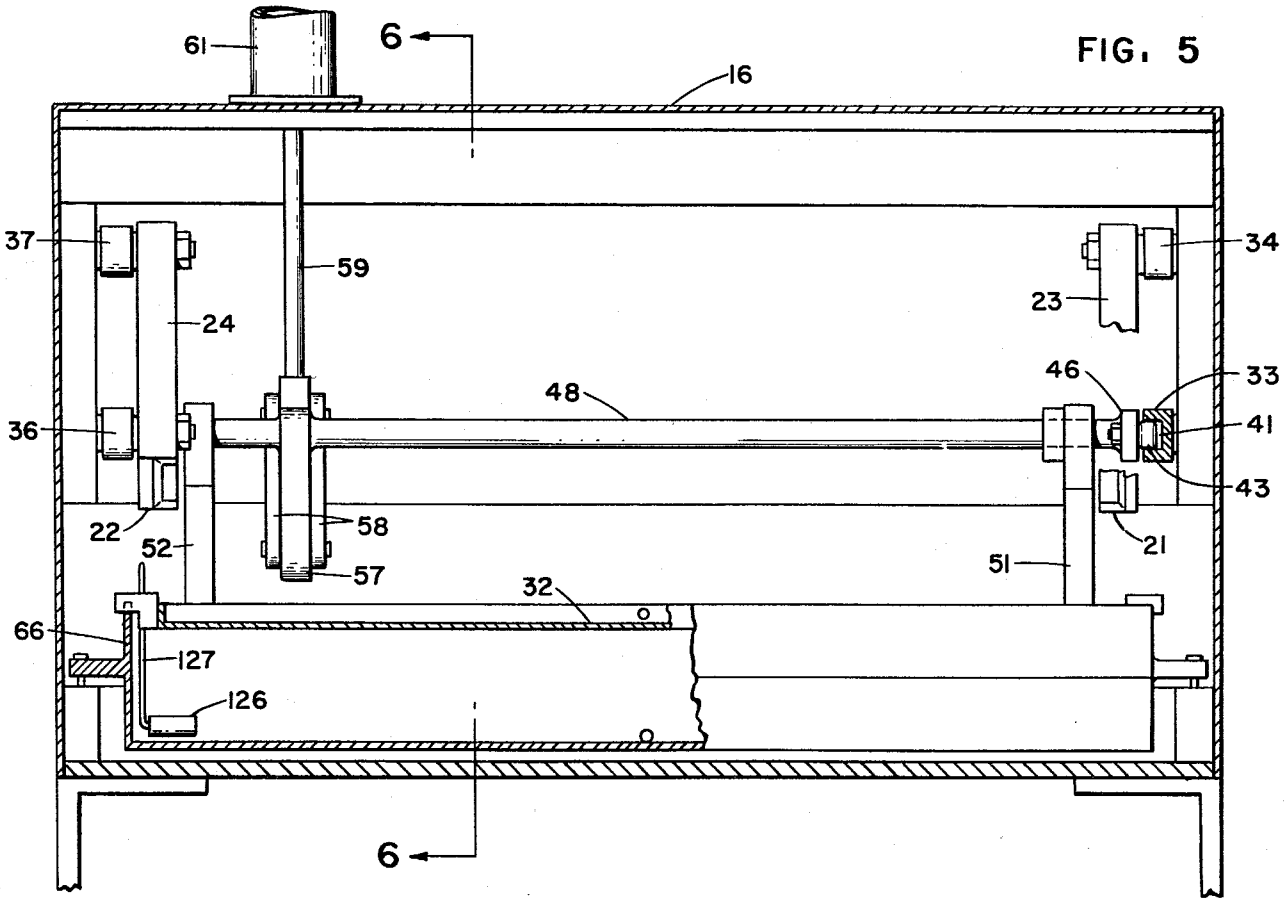
FIG. 5 is a view of the back of the apparatus with a back wall enclosure section removed.

The lubricant applying apparatus as shown in FIGS. 3 and 4 is enclosed in a housing 16 having a front wall 17 in which is formed an entry opening 18 through which a number of magazines may be loaded into a holder generally designated by the reference numeral 19. The holder 19 includes a pair of horizontal bar-like members 21 and 22, see FIGS. 3 and 6, having a pair of vertically extending lift arms 23 and 24. The horizontal holder members 21 and 22 are provided with a pair of facing longitudinally extending slots 26 and 27 to receive and support the ends of a pair of magazines loaded with connectors. When the holder 19 is loaded with magazines and a door 28 is moved over the entry opening 18, an elevator mechanism 31 is operated to impart a translatory movement to the holder 19 to move the connectors toward a shallow tank 32.

Attention is directed to FIGS. 3, 5, 6 and 7 for a consideration of the elevator mechanism 31 for moving the holder. The vertically extending arms 23 and 24 are each pivotally secured to a pair of parallel linkages. The arm 23 is secured to links designated 33 and 34 while the arm 24 is pivotally secured to the links designated 36 and 37. Links 33 and 36 are formed with longitudinally extending slots 41 and 42 into which extend pins 43 and 44 projecting from crank arms 46 and 47 fixed to opposite ends of a shaft 48. Shaft 48 is rotatably mounted in a pair of brackets 51 and 52 fixed to back frame uprights 53 and 54 which also provide a mounting for a back wall 56 of the housing 16. Secured to the shaft 48 is a link 57 which is pivotally connected to a pair of links 58 that are pivotally mounted on the end of a piston rod 59 extending from an air cylinder 61.

Upon operation of the air cylinder 61, the piston rod 59 moves down to flex the links 58 and 57 and thus rotate the shaft 48 and the crank arms 46 and 47. The crank arms pins 43 and 44 act against the lower surfaces of the slots 41 and 42 in the arms 33 and 36 to pivot these arms which causes the vertical holder arms 23 and 24 to move downwardly in a slight arc. The downward movement of the arms 23 and 24 is constrained by the parallel arms 34 and 37 so that the holder arms 23 and 24 are held to a vertical movement and move through the slight arc in a translatory manner. Movement of the arms 23 and 24 effect the downward movement of the connectors toward the tank 22.

The tank 32 is relatively shallow and is supported within an overflow catch receptacle 66 having a slanted bottom 67 for concentrating overflow lubricant to flow through an exit pipe 68 running to a confined storage reservoir or vessel 69. Lubricant is extracted from the reservoir 69 through a pipe 71 by a pump 72 and delivered through a pipe 73 to an entry orifice 74 formed in a sidewall of the of the shallow tank 32. The tank bottom is provided with a drain orifice 75 so that the tank is emptied upon interruption of operation of the pump.

The entry door 28 (see FIG. 4) is mounted on the front panel 17 of the enclosure 16 and is confined to move in a vertical fashion by guideways 76 and 77 secured to the front panel 17. The mechanism for operating the door is best shown in FIGS. 3 and 4 and includes a pair of toggles 78 and 79 having upper ends thereof connected by pins to the door 28. The lower ends of the toggles are pivotally mounted on the front panel of the enclosure. The joints of the toggles 78 and 79 are pivotally connected to rods 81 and 82 which, in turn, are pivotally mounted on pins 83 and 84 projecting from a wheel 86 mounted on an axle 87. Secured to and projecting from the wheel is a handle 88. When the handle is moved in a clockwise direction, as shown in FIG. 4, the wheel rotates to move the rods 81 and 82 to collapse the toggles 78 and 79, whereupon forces are applied to move the door 28 downwardly to expose the entry opening 18.

When the handle 88 is operated to close the door 28 to the position shown in FIG. 4, an actuator rod 91 is pushed by the toggle 78 to pivot a lever 92 to operate a switch 93 which initiates operation of the pump 72 and the air cylinder 61. When the air cylinder 61 operates to drive the piston rod 59 in a downward direction the mechanism 31 is actuated and the holder 19 is moved downward so that a spring-biased and weighted arm 96 (see FIGS. 3 and 6) normally bearing on holder member 22 also moves in a downward direction to pivot a lever 97. The pivoting lever 97 moves a lock pin 98 mounted on a lower end thereof through an opening 99 in the front panel 17 and into a position beneath the closed door 28 to lock the door in position to cover the enclosure entry opening 18.

Figure 9:
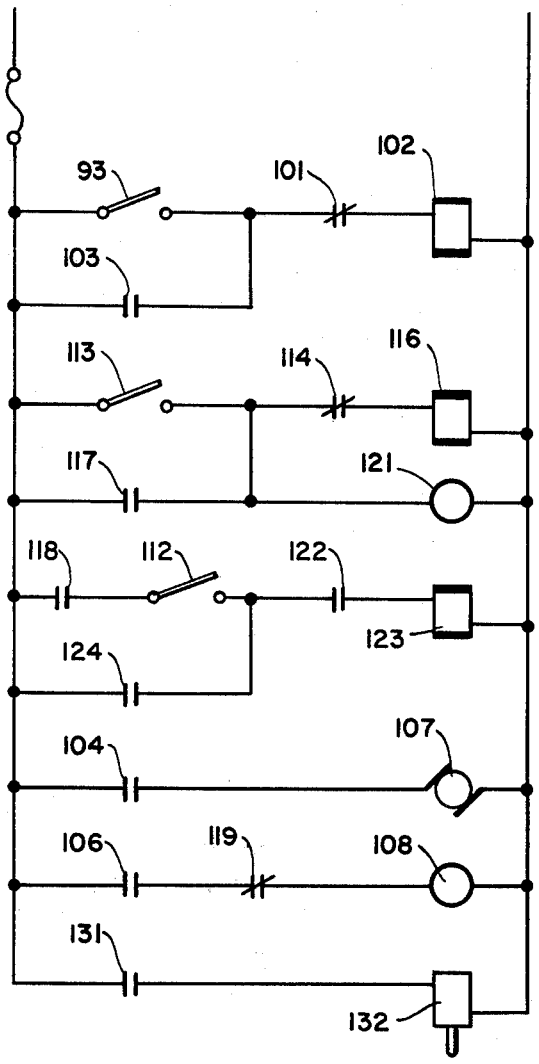
FIG. 9 is a diagram of a circuit for controlling the sequential operation of the apparatus.

Consider now the overall operation of the apparatus and with particular reference to FIGS. 3 and 9, the holder 19 is loaded with magazines of terminals and the handle 88 is swung to close the door 28, whereupon the switch 93 is closed to complete an energizing circuit through a closed relay contact 101 to a relay 102. Energization of relay 102 closes relay locking contacts 103, pump motor contacts 104 and air cylinder operate contacts 106. Closure of the contacts 104 energizes a motor 107 for the pump 72, whereupon lubricant is applied over pipeline 73 to the tank 32. The tank 32 is filled with lubricant at a rate greater than the rate of flow through the drain orifice 75 so that the lubricant overflows the tank perimeter and falls within the overflow receptacle 66 and from there back into the reservoir 69. Closure of contacts 106 energizes an air cylinder down solenoid 108 to effectuate the admission of air to the cylinder 61 so that the cylinder is effective to drive the piston rod 59 in a downward direction. The parallel arm linkage mechanism 31 imparts a translatory movement to the holder 19 to move the projecting connector terminals 12 downwardly into the lubricant being pumped into the tank 32. The downward movement of the upright holder arm 23 moves a switch actuator 111 away from switch 112 and eventually into contact with a switch 113.

As shown in FIG. 9, when switch 113 is closed, a circuit is completed through a set of normally closed contacts 114 to energize a relay 116. Relay 116 operates to close locking contacts 117 and contacts 118. The energization of relay 116 also opens contact 119 and interrupts energizing circuit for the air cylinder down solenoid 108. Closure of contacts 117 completes an energizing circuit for an air cylinder up air solenoid 121 associated with the air cylinder 61. Energization of solenoid 121 causes the air cylinder 61 to withdraw the piston rod 59 to initiate an upward movement of the holder 19. When holder 19 is restored to the initial position, the actuator 111 operates a switch 112 to complete an energizing circuit through the now closed contacts 118 and contacts 122 associated with the still energized relays 102 and 116 to operate a relay 123. Operation of relay 123 closes locking contacts 124 and opens contacts 101 to release relay 102. De-energization of relay 102 is accompanied by an opening of the contacts 104 to interrupt the circuit for energizing the motor 107 for the pump 72. The flow of lubricant into the tank 32 is interrupted and the residual lubricant rapidly drains through the exit orifice 75 into catch receptacle 66 and then flows through pipe 63 into the storage reservoir. The drain is of such size that by the time that the air cylinder 61 and the activated linkage mechanism 31 is restored to the up position, the lubricant is not only drained from tank 32 but also from the catch receptacle 66. Energization of relay 123 also opens contacts 114 to de-energize relay 116, whereupon the energizing circuit through contacts 117 for the solenoid 121 is interrupted. The de-energization of relay 102 is effective to open the contacts 122 to de-energize the relay 123, and hence restore the overall control circuit to the initial condition.

A further feature of the invention resides in an added locking instrumentality to ensure that all of the lubricant is substantially drained from both the tank 28 and the lower portion of the overflow receptacle 66 before the door 23 may be opened. More specifically, referring to FIGS. 8 and 9, there is shown a float 126 resting at the low portion of the receptacle 66 near the juncture of the slanted bottom 67 and the right hand vertical wall of the receptacle. The float is secured to a first free end of a lever 127 pivotally mounted on a stud shaft 128 fixed to the housing 17. The lever 127 has at its opposite free end a permanent magnet 129 mounted thereon to operate a magnetic switch 131. The lever is constructed and mounted on the stud shaft 128 in such a manner that the weight of the lever tends to rotate the lever in a counter clockwise direction to urge the float to follow the level of the pool of lubricant in the receptacle 66.

At the conclusion of a lubricant applying operation, the pump 107 ceases to pump the lubricant and the pool of lubricant in the receptacle 66 is drained over line 68, thus causing the float 126 to move to the lowest part of the receptacle. The lever 127 pivots in a counter clockwise direction to position the magnet 129 in proximity to the switch 131. The switch 131 may be a commercial reed type switch that is encased in a glass tube and includes a magnetically attractable contact that opens to interrupt a circuit running to a solenoid 132. As shown in FIG. 8, solenoid 132 controls a locking plunger 133 that is normally spring-biased through an opening in the housing 17 into a position to block downward movement of the door 28 from a position overlaying the entry opening 18. When all the fluid is drained from receptacle 66, the switch 131 is opened and the solenoid 132 is de-energized, thus permitting the spring urged plunger to move from the door blocking position.

When the apparatus is loaded with magazines 13 of connectors 10 and the door 28 is closed to initiate a cycle of operation, the pump rapidly fills the tank 28 to overflow lubricant into the receptacle 66. A pool of lubricant quickly forms in the lower portion of receptacle 66 to buoy the float 126 and hence pivot the lever 127 whereupon the magnet 129 moves away from the switch 131. The size of the pipe 68 is selected to allow the build-up of the pool of lubricant within the receptacle 66. Due to the slanted construction of the bottom 67 of the receptacle there is a rapid build-up of the pool of lubricant in the lower portion of the receptacle. Shortly after a cycle of operation commences the float 126 moves the magnet 129 from proximity of the switch 131 so that the switch contacts open and the solenoid 132 is de-energized permitting the spring urged plunger 133 to be thrust into the blocking position.

In summary, it may be appreciated that lubricant is only present within the tank 32 at times when the door 28 is closed. The system is such that during the terminal lubricating application, there is a continuous flow of lubricant into the tank 32. Lubricant overflowing the tank 32 is directed by the slanted bottom 67 of the receptacle 66 to the exit pipe 68 running to the reservoir 69. With the dual lock arrangement, all lubricant is withdrawn from the receptacle 66 before the entry door can be opened, hence, minimizing exposure to the attending operator to noxious fumes.

What is claimed is:

1. An apparatus for applying liquid to an article, which comprises:

an enclosure having an entry door movable from an open to a closed position;

a tank within the enclosure for receiving a quantity of liquid;

a holder for supporting an article with a section extending downwardly toward said tank;

an elevator mechanism for lowering the holder from a load position toward said tank to move the extending section of the article within said tank, and then return said holder to the load position;

means responsive to the closure of said entry door for operating said elevator mechanism;

means responsive to the closure of said entry door for filling said tank with liquid; and means rendered effective during the return of said elevator mechanism to the load position for draining the liquid from said tank.

2. An apparatus for applying a lubricant to an array of terminals projecting from a connector, which comprises:

an enclosure having an entry opening;

a horizontal holder within the enclosure for receiving and supporting a connector with the terminals projecting downwardly;

a tank within the enclosure positioned beneath the holder for receiving a supply of lubricant;

an overflow receptacle positioned beneath the tank for receiving lubricant overflowing the edges of the tank;

a system including a lubricant storage reservoir for receiving lubricant from the overflow receptacle and for pumping the lubricant from said storage receptacle into said tank;

means for imparting a translatory motion to said holder to move said holder toward said tank to immerse the terminals in said tank of lubricant, and then away from said tank;

a door mounted on said enclosure for movement to overlay said entry opening; and means responsive to movement of said door to overlay said entry opening for initiating operation of said system to pump lubricant into said tank and for initiating operation of said translatory motion imparting means to move said holder toward and away from said tank to immerse terminals projecting from said holder into said tank of lubricant.

3. An apparatus as defined in claim 2 which comprises:

a pin for locking said door to overlay said entry opening; and a lever arrangement having an arm bearing on said holder for moving said pin to lock said door upon movement of said holder toward said tank.

4. An apparatus as defined in claim 2 wherein said translatory motion imparting means includes:

an arm projecting vertically from said horizontal holder;

a pair of parallel links pivotally connected at first ends to said arm and pivotally connected at second ends to said enclosure, one of said arms having a longitudinally extending slot;

a crank arm having a pin extending therefrom to ride within said slot; and means responsive to the closure of said door for rotating said crank arm to pivot said parallel links to impart a translatory motion to said holder.

5. An apparatus for applying liquid to an article, which comprises:

an enclosure with an entry opening;

a holder within the enclosure for supporting an article;

a tank positioned within the enclosure for receiving a liquid;

means for imparting a translatory movement to said holder to move said holder toward said tank to immerse the article in said liquid, and then away from said tank;

a liquid system for pumping liquid into said tank;

a door movably mounted on said enclosure for closing said entry opening;

means responsive to the closing of said door for operating said translatory movement imparting means to move said holder toward said tank;

means also responsive to the closing of said door for operating said system to pump liquid into said tank at a predetermined rate to overflow said tank;

said tank having a drain opening formed therein for drawing liquid therefrom at a rate less than said predetermined rate;

an overflow catch receptacle for receiving the liquid overflowing said tank and the liquid drawn from the tank through said drain opening;

means responsive to a predetermined movement of said holder toward said tank for reversing said movement to move said holder away from said tank; and means responsive to movement of said holder away from said tank for interrupting said pumping to drain the liquid from said tank into said receptacle.

6. An apparatus as defined in claim 5, which includes:

a closed storage vessel;

means interconnecting the lower portion of said overflow catch receptacle and said storage vessel for draining liquid from said overflow catch receptacle into said closed storage vessel.

7. An apparatus as defined in claim 5 which includes:

a lock pin movably mounted to extend through said enclosure to block movement of said door from said entry opening;

a linkage moved by said movement by said holder toward said tank for moving said lock pin to block movement of said door from said entry opening.

8. An apparatus as defined in claim 5, which includes:

a second lock pin movably mounted to extend through said enclosure to block movement of said door from said entry opening;

a float buoyed on liquid within said overflow catch receptacle; and means responsive to said float being buoyed on said liquid for moving said second lock pin to extend into position to block movement of said door.

9. An apparatus as defined in claim 8 wherein said overflow catch receptacle has a slanted bottom to concentrate the initial flow of liquid along a lower edge portion of the receptacle, and said float is positioned within the vicinity of said lower edge portion so that initial flow of liquid into the receptacle causes said float to be buoyed upwardly to actuate the means to set the second lock pin in door blocking position.

10. An apparatus for applying lubricant to end sections of parallel terminals projecting from a connector, which comprises:

an enclosure having a front wall with an entry opening and a guide opening therein;

a door slideably mounted on said enclosure for movement from a first position exposing said entry opening to a second position overlaying said entry opening, said door being positionable beyond said guide opening when said door is in said second position;

a tank positioned within a bottom portion of said enclosure;

a holder within said enclosure for supporting a connector with the terminals projecting toward said tank;

means mounting said holder for movement from a first load position in alignment with said enclosure entry opening to a second immerse position adjacent to said tank;

means for sliding said door to expose and close said entry opening;

a fluid system for pumping lubricant into said tank and drawing the fluid from said tank at a rate that is less than the rate of flow of lubricant into the tank;

means operated upon sliding said door to close said entry opening for operating said fluid system to pump lubricant into said tank;

means also operated by the closing of said door for moving said holder from said first position to said second position to immerse the terminals of the connector supported by said holder in said tank;

a latch means including a pin movable through said guide opening and into position to block movement of the door away from said entry opening;

means operated by said holder moving toward said second position for operating latch means to move said pin through said guide opening to lock the door in said second position;

means responsive to the movement of said holder to said immerse position for moving said holder from said immerse position to said load position and for interrupting the pumping of the lubricant by said fluid system while continuing to drain the lubricant from said tank; and said holder being effective upon movement from said immerse position to said load position to withdraw the pin from said door blocking position.

* * * * *